United States Patent [19]

Serna

[11] Patent Number: 4,571,200

[45] Date of Patent: Feb. 18, 1986

[54] MODULAR TOY BUILDING SET

[75] Inventor: Jaime Serna, Barcelona, Spain

[73] Assignee: Mattel, Inc., Hawthorne, Calif.

[21] Appl. No.: 671,542

[22] Filed: Nov. 15, 1984

[51] Int. Cl.[4] ..... A63H 33/04

[52] U.S. Cl. ..... 446/85; 52/263; 52/584; 446/111

[58] Field of Search ..... 446/85, 105, 108, 111, 446/116, 120, 124, 126, 113, 476; 52/126.6, 263, 584, 608

[56] References Cited

U.S. PATENT DOCUMENTS

| | | | |
|---|---|---|---|
| 311,793 | 2/1885 | Stranders | 446/105 |
| 2,676,420 | 4/1954 | Berg | 446/113 X |
| 2,921,347 | 1/1960 | Solomon | 20/2 |
| 3,295,272 | 1/1967 | Kanno | 52/126.6 |
| 3,415,007 | 12/1968 | Howe | 46/19 |
| 3,803,754 | 4/1974 | Fischer | 46/26 |
| 4,185,411 | 1/1980 | Fischer | 46/23 |
| 4,209,934 | 7/1980 | Ogawa | 446/126 X |

FOREIGN PATENT DOCUMENTS

| | | | |
|---|---|---|---|
| 5832 | of 1914 | United Kingdom | 446/111 |

*Primary Examiner*—Mickey Yu

*Attorney, Agent, or Firm*—Ronald M. Goldman; Melvin A. Klein; Daniel F. Sullivan

[57] ABSTRACT

There are disclosed basic construction elements for forming toy modular units. The elements consist of polygonal shaped structural connecting members (10) into which the corners or one three sided opening of floor panels (14) may be inserted and held. Supporting members or columns (12) are inserted into circular openings (22) formed in the connecting members to hold the floor panels to the connecting members and to support connecting members and further floor members so as to form open modular structures (16). The structures may be easily put together by a child user, and are safe because the construction prevents children from climbing on them since the easily taken apart elements are fitted together in such a manner that a predetermined load applied to the top of an assembled structure will cause it to break apart.

7 Claims, 12 Drawing Figures

FIG. 1
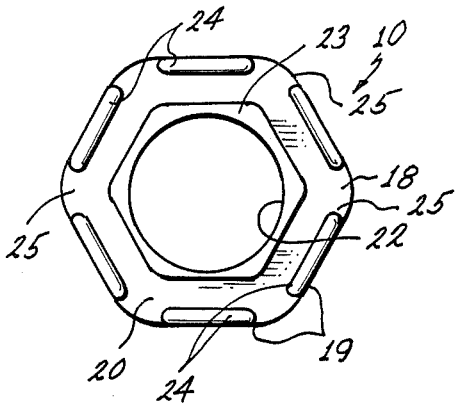
FIG. 2
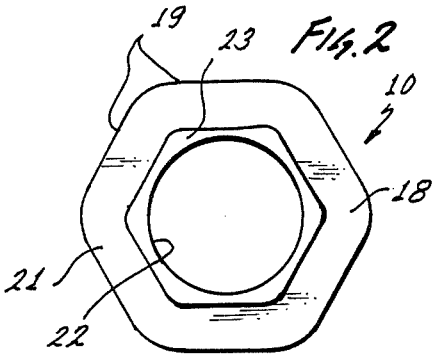
FIG. 3
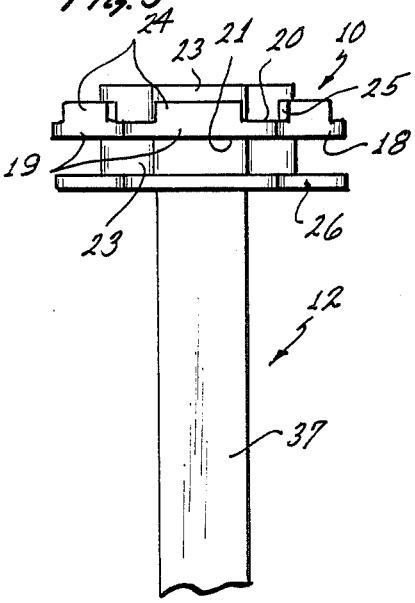
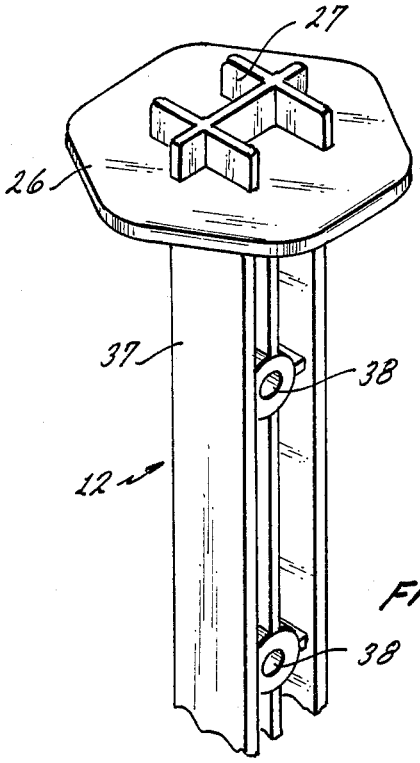
FIG. 4

27
26
38
37
12
22
10
18
23
19
21
20
31
14
30
14d
14a
39
29
14c
14b
28

16
22
10
14
14d
22
18
30
14a
39
10
23
23
22
30
14d
39
18
30
26
14b
29
14c
30
26
14a
12
18
23
14b
39
26
10
12
38
12
37
14
37
26
39
37
39
26
18
26
39
38
10
10
14
39
18
26
18

MODULAR TOY BUILDING SET

TECHNICAL FIELD

This invention relates generally to modular toy building sets and more particularly to a toy building set having three basic structural components which may be safely played with by children of all ages.

BACKGROUND ART

There are many and diverse types of toy building sets which may be erected and taken down by a child user to build fanciful buildings, play environments, and the like. Examples of such building sets are shown in U.S. Pat. No. 3,415,007, issued Dec. 10, 1968; U.S. Pat. No. 3,803,754, issued Apr. 16, 1974; and U.S. Pat. No. 4,185,411, issued Jan. 29, 1980. Each of these patents discloses a toy building set having various structural elements and blocks which may be held or fitted together in various configurations to form structures.

In addition, U.S. Pat. No. 2,921,347, discloses a knock-down structure, utilizing a structural joint which is used to assemble and disassemble plates and elongated members.

However, none of the above prior art discloses an easy to use, safe, modular structural system having structural connecting members which will break away or come apart from floor panels and supporting columns if too much weight is applied by a child user.

DISCLOSURE OF THE INVENTION

In one aspect of the invention there is provided a modular toy building set having a structural connecting member for use in assembling floor panels and support columns. The connecting member comprises a polygonal shaped body having a plurality of sides which connect upper and lower surfaces on the body. Each of the upper and lower surfaces include centrally thereof hollow depressions having upstanding side portions, and a plurality of upstanding ribs are formed on one of the upper and lower surfaces adjacent the side edges. Floor panels and elongated supporting columns or members are fitted to the connecting members to form shaped chambers and/or platforms to be used by a child playing with the same.

DESCRIPTION OF THE DRAWINGS

FIG. 1 is a top plan view of a preferred connector member of the subject invention;

FIG. 2 is a bottom plan view of the connector shown in FIG. 1;

FIG. 3 is a partial top plan view of an elongated supporting element of the present invention with a connecting member, as shown in FIGS. 1 and 2, attached to one end thereof;

FIG. 4 is a partial perspective view of one end of the elongated supporting element of FIG. 3, showing the shape of an end cap and the means for fitting the supporting element into a connecting member;

BEST MODE FOR CARRYING OUT THE INVENTION

Figure 8:
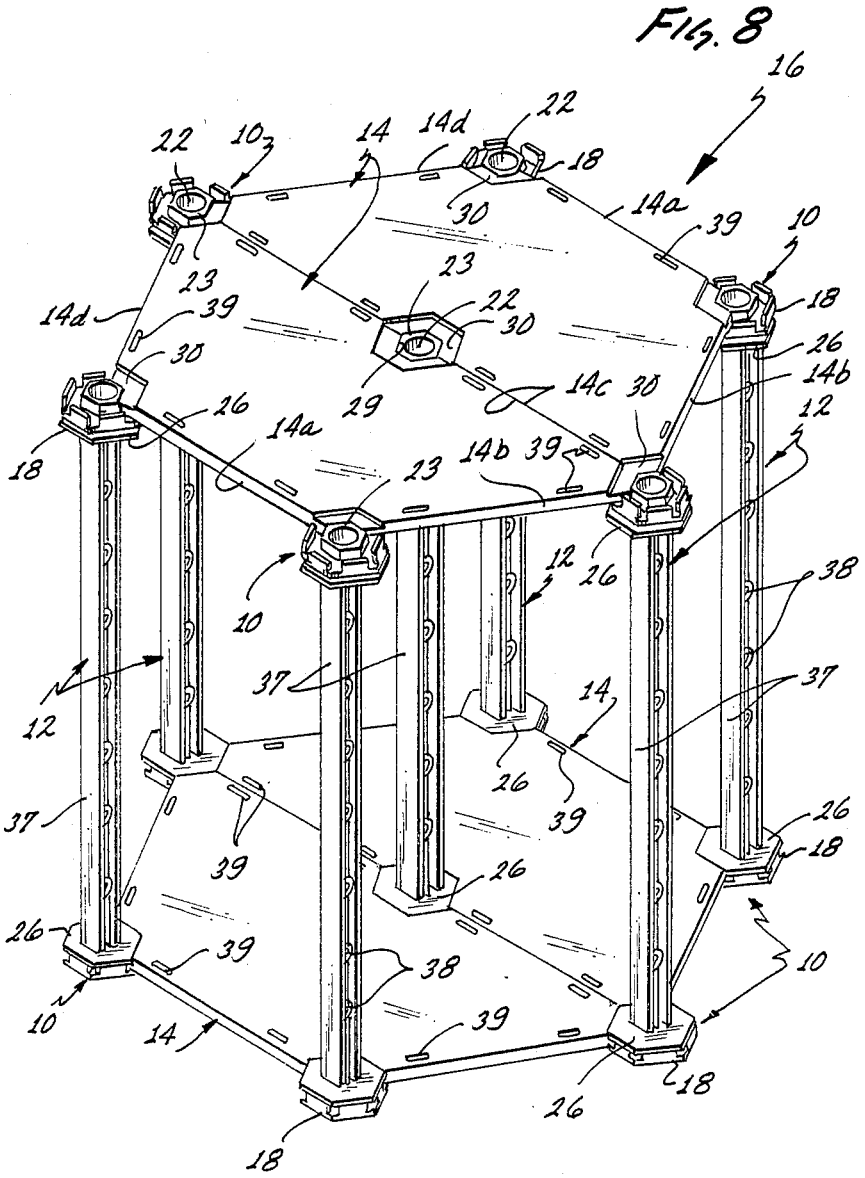
FIG. 8 shows a room or the like constructed from a plurality of members.
Figure 10:
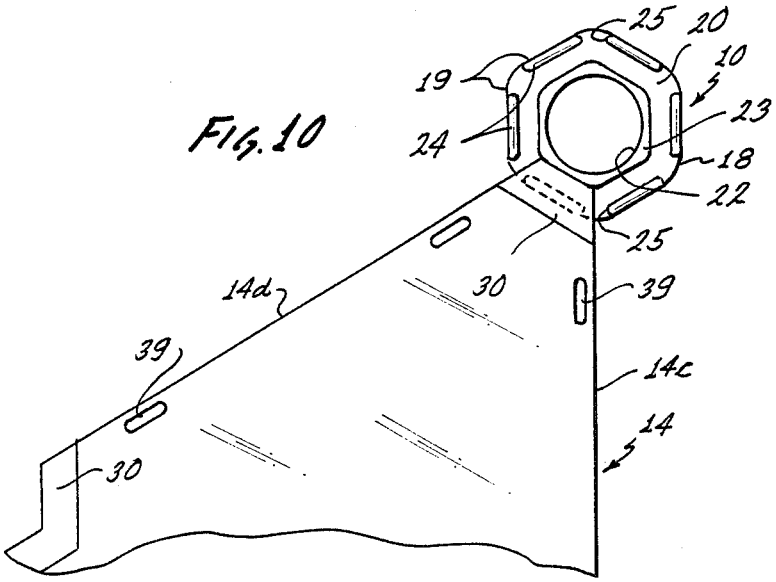
FIG. 10 is a top plan view, similar to that shown in FIG. 9 showing a connecting member connected or held to one corner of the floor member.
Figure 11:
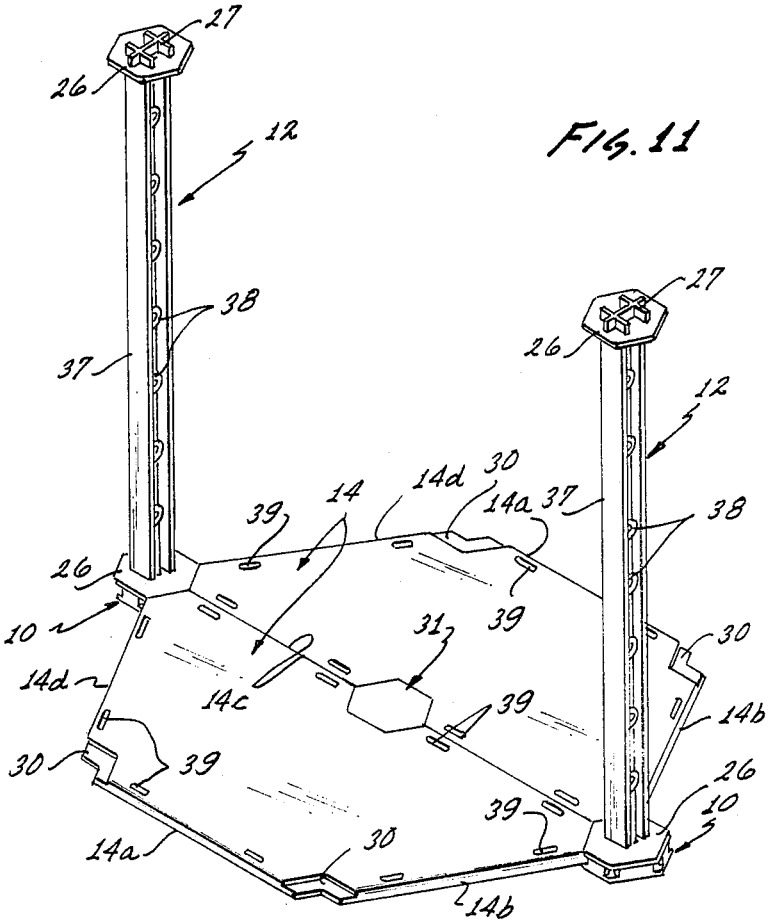
FIG. 11 is a partial perspective view showing two floor members held together by connecting members with a blank covering member connected substantially centrally of the two floor members, and a pair of supporting members held in opposite corners on the floor members.
Figure 12:
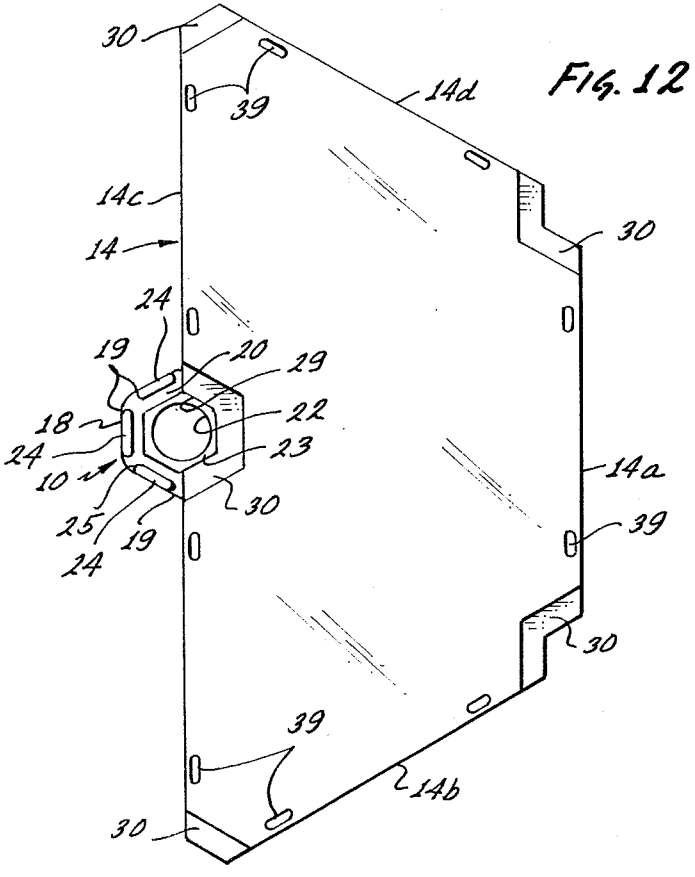
FIG. 12 is a top plan view of the bottom of one floor member and the top of another, with a connecting member held in place in the central opening on the longer side.
Figure 12:
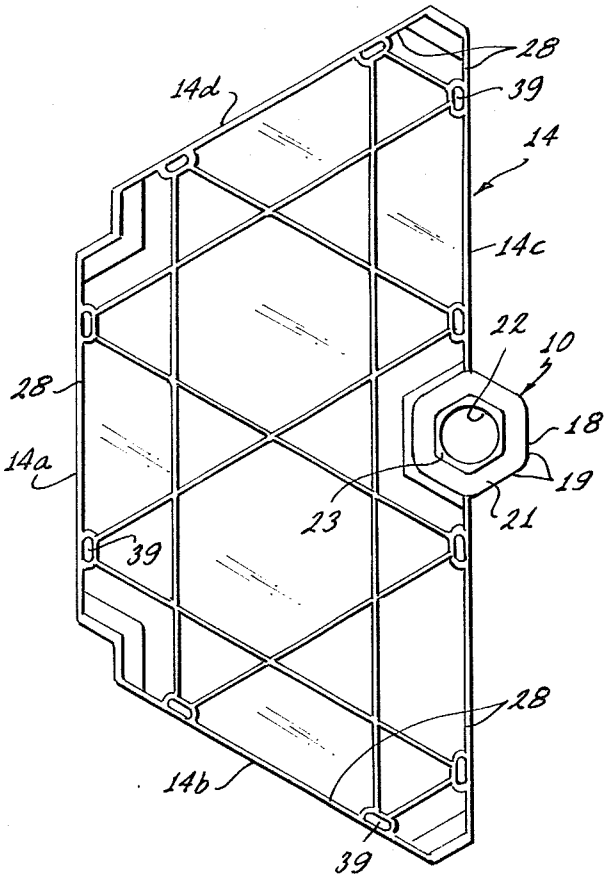

Turning now to the accompanying drawings in which like reference characters refer to like elements in the several views, FIGS. 1 and 2 show a presently-preferred embodiment of a structural connecting member 10 for holding other members of a toy-building set together. These other members comprise an elongated member 12, such as a supporting column or spacer, and a floor or plate member 14. A plurality of members 10, 12 and 14 are connected together to form modular structures such as structure 16 shown in FIG. 8, described more fully hereinafter.

In the preferred embodiment of the structural connecting members 10 there is provided a polygonal shaped main body 18 such as a hexagon, having a plurality of edges or sides 19 connecting an upper surface 20 and a lower surface 21. Each of the upper and lower surfaces, 20, 21, include a central hollow depression 22. The depressions are preferably circular and connected together so as to form a central opening extending entirely through the connecting member. The central circular opening or each depression 22 is surrounded on each surface by an upstanding side portion 23 having a substantially circular central portion formed around the central circular opening and a number of flattened outer sides, substantially parallel to and equal in number, to the side edges of the polygonal shaped body 18.

On one of the upper and lower surfaces of the connecting member, preferably the upper surface 20, there are provided a plurality of outer ribs 24, equal in number to the polygonal side edges 19. The ribs are of a predetermined height, and extend only partially along each of the side edges. That is, the ribs, stop short of connecting to each other to thereby form a plurality of openings 25, therebetween substantially adjacent to the corner edges of each of the side edges 18.

The central opening 22 of each supporting member 10 is formed so as to snuggly carry or support one or more elongated support members 12 therein. This is accomplished by the provision of enlarged end or cap members 26, formed on each end of the elongated support member. These end caps 26 are substantially the same size and shape as the structural connecting members 10. Extending outwardly from the center of each of the end caps there is provided a fixing or holding means 27. The fixing or holding means 27 is of a size, and shaped so as to fit snuggly in, and to be easily removed from, the circular central openings 22 of a structural connecting member 10. The end caps 26 are spaced apart by a central supporting rod 37 of any desired length, and which may have a plurality of openings 38 therein to enable other elements or means to be inserted in and held to the supporting rod 37.

The toy play set of the present invention also includes a plurality of floor or plate-like members 14, basically trapezoidal in shape having side edges 14*a, b, c,* and *d*. The corners of the floor members are sized and shaped so that the rib portions 24 of a connecting member 10 may fit snugly therein, and be held in place at the corners. In addition, the longer side edge 14*c* is provided with a three sided opening 29 substantially centrally thereof.

As shown in FIGS. 5, 7, 9 and 12 the bottom surface of the floor member 14 is formed with a raised edge portion 28. Therefore, when one of the rib portions 24 of a connecting member 10 is fitted over the edge portion 28 at one of the four corners, or at the central opening 29, on each of the floor members 14 (see FIGS. 8–12) the ribs 24 are pressed against the edge 28 to hold the members together, with the edge 28 entering into or passing through adjacent openings 25.

Figure 5:
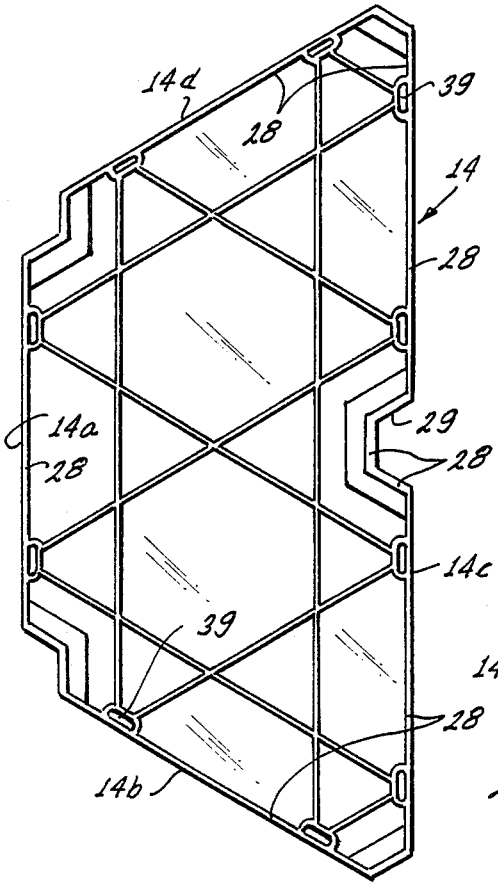
FIG. 5 is a bottom plan view of a preferred floor member of the present invention.
Figure 6:
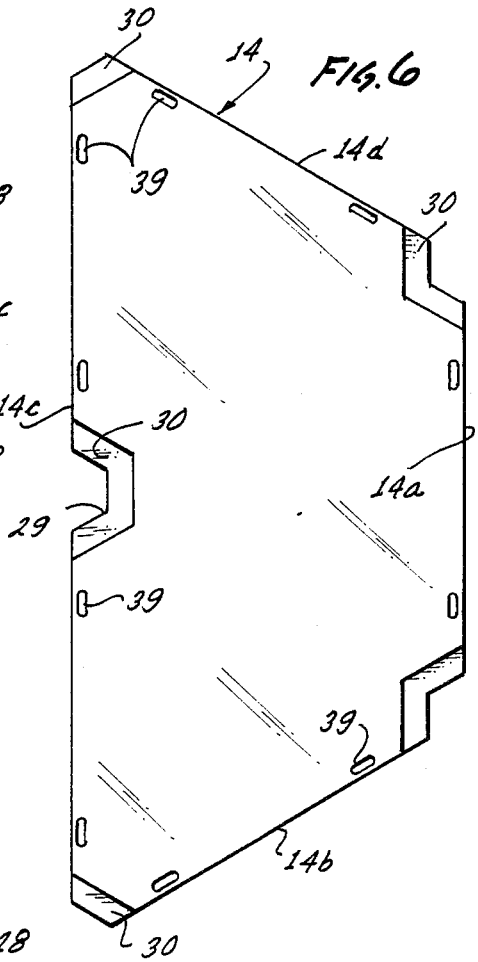
FIG. 6 is a top plan view of a the floor member of FIG. 6.
Figure 9:
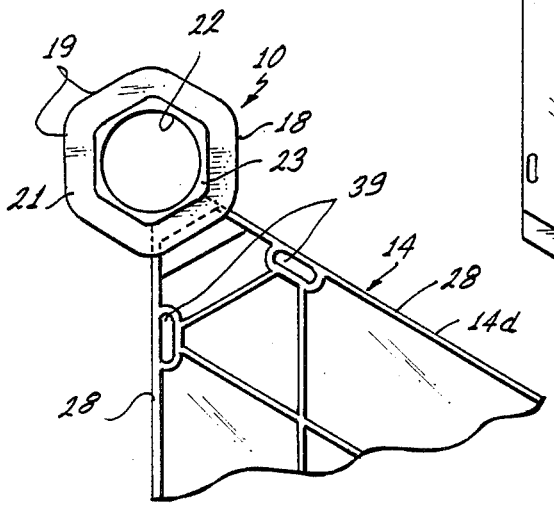
FIG. 9 is a partial bottom plan view showing the manner in which a connecting member is connected or held to one corner of a floor member.
Figure 7:
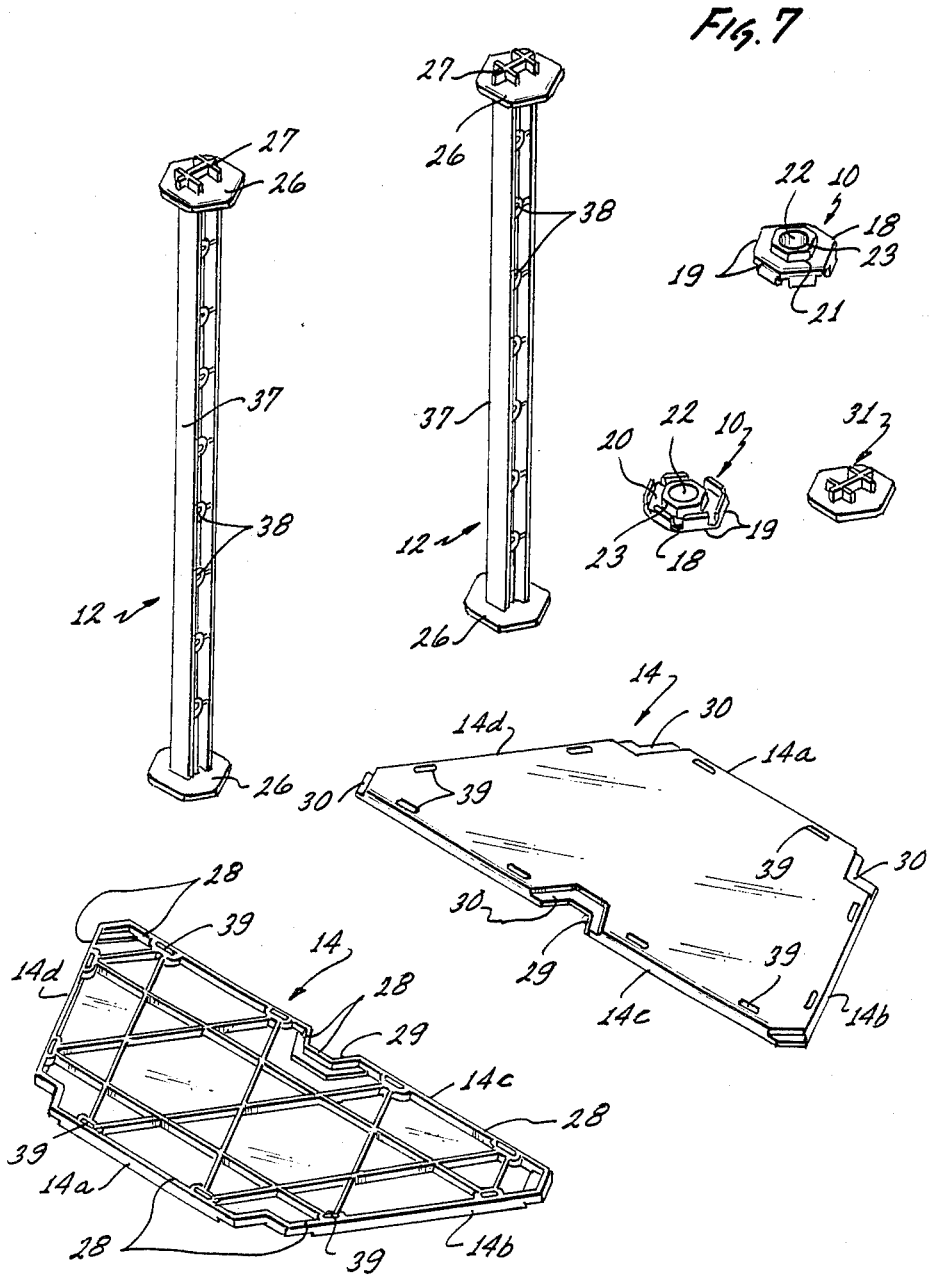
FIG. 7 is a perspective view showing a plurality of connecting members, floor members, and elongated supporting members together with a blank covering member.

As shown in FIG. 6, the top surface of each of the floor sections 14 is provided with depressed areas 30 to enable the end caps 26 of an elongated support 12 to be fitted or held therein. When in place, the end caps 26 help to hold the floor members between a connecting member 10 and the end cap, as more clearly shown in FIGS. 8, 11 and 12. The top surface is also provided with openings 39, along its periphery. Various further elements such as walls, cranes, tools, etc., may be inserted in and removeably held in these openings.

In addition, a smooth blank covering member 31 may be inserted in any central opening 22 of a connecting member 10 in which no supporting member 12 has been inserted, to cap it off or to provide a smooth surface or floor. The smooth blank 31 is provided with a holding portion extending from its lower surface substantially identical to the holding portion 27 provided on the end caps 26 of each of the support members 12.

To use the elements of the child's play set, connecting members 10 are connected to all or some of the corners of each of the floor members 14 to be used (see FIGS. 8–12). The rib portion 24 of each connecting member 10 is captured against a part of the raised edge portions 28 on the bottom of the respective floor panel. In addition, as described above, the raised edge 28 passes through aligned openings 25 formed on each of the connecting members 10. In the examples illustrated in FIGS. 8 and 11, floor members 14 are connected together, by connecting members 10 inserted and held at the corners and the central openings 29. A blank cover member 31 is shown inserted in the central openings 29 of FIG. 11, to provide a substantially flat floor. Elongated supporting members 12 are then inserted into each of the central openings 22 of the connecting members. Further connecting members 10 are connected to the upper ends 26 of each of the support members 12, and further floor members 14 are connected thereto to form a top surface.

It is obvious from the above that further floor members 14 may be attached to connecting members 10, and further spacing or supporting members 12 attached thereto form interconnecting rooms or chambers 16, having open sides. As many chambers 16, as desired, or other shaped chambers may be built and connected together, above, below, beside, or extending outwardly from each other.

In the assembled position, the ribs 24 of the connecting members 10 are held against adjacent raised edges 28 of the floor members 14, and end caps 26 may have the holding means 27 thereof inserted in the central openings 22, with the edge portions of the end caps in adjacent depressed portions 30. However, the child's play set of the present invention has been designed so that if a force of approximately 15 pounds or more is applied against the top of an assembled structure, such as the chamber 16, the connecting members will be caused to be cammed away or separate from the raised edge portions 28. In addition, the holding means 27 will be forced out of or separate from the central openings 22, to thereby cause the chamber or structure to collapse. Because of this unique design, a child of tender years will be unable to step up on the assembled chamber 16, and or other structures made from the elements of this play set. In addition, when separated, because of the weight applied thereto, there will be no sharp edges to puncture or injure the child user. It therefore can be seen that the instant invention provides a safe, easy to use child's play set.

While the particular child's play set and components thereof shown and described in detail herein are fully capable of attaining the objects and providing the advantages above stated, it is to be understood that they are merely illustrative of the presently preferred embodiment of the invention. No limitations are intended in the details of the construction, design or materials shown, other than as defined in the attached claims, which form a part of this disclosure.

The term "means" as employed in the claims is to be interpreted as defining the corresponding structure illustrated and described in the specification or the equivalent thereof.

I claim:

1. In combination, a plurality of structural members capable of being removably connected together to form a structure, the improvement comprising:

at least one polygonal shaped structural connecting member having a plurality of side edges connecting upper and lower surfaces, a central circular opening passing therethrough surrounded by an upstanding side portion on both of said surfaces, and a plurality of upstanding rib sections formed on one of said upper and lower surfaces adjacent to said side edges;

at least one elongated structural supporting member having an elongated central rod and spaced apart end caps, each of said end caps being provided with an upraised holding portion sized and shaped so as to be capable of being inserted into and snugly held in the circular central opening in said at least one structural connecting member; and a floor member sized and shaped so as to be capable of having said structural connecting member connected thereto at predetermined locations, whereby said structural connecting member will further support said elongated structural supporting member in said central opening, with said floor member interposed between said connecting member and said support member to enable said structural members to be easily taken down or broken away.

2. The combination of claim 1, including a plurality of connecting members, a plurality of supporting members, and a plurality of floor members, and wherein said plurality of members may be assembled together to form a structure having a top, which structure will be disassembled if a predetermined load is applied to said top.

3. The combination of claim 1 wherein the connecting member includes an equal number of ribs and side edges in each of said upper and lower surfaces are circular and connected to the other so as to form a circular central opening extending through said connecting member.

4. The combination of claim 3 wherein each of said ribs is shorter than each of said side edges to form a plurality of openings between said ribs on said surface on which they are formed.

5. The combination of claim 4 wherein said surface opposite to that on which said ribs are formed is substantially flat, outside of said upstanding side portion surrounding said central opening.

6. The combination of claim 5 wherein said upstanding side portion of said central opening include a smooth circular interior surface and a faceted outer surface having flattened sides substantially parallel to said side edges.

7. The combination of claim 6 wherein said connecting member body is hexagonal in shape.

* * * * *